United States Patent [19]

Sherman

[11] Patent Number: 4,536,969

[45] Date of Patent: Aug. 27, 1985

[54] HOT WATER DRYING OF LOW RANK COAL

[75] Inventor: Michael I. Sherman, Glens Falls, N.Y.

[73] Assignee: Kamyr, Inc., Glens Falls, N.Y.

[21] Appl. No.: 537,718

[22] Filed: Sep. 30, 1983

[51] Int. Cl.[3] ..... F26B 3/00

[52] U.S. Cl. ..... 34/9; 34/35; 34/86

[58] Field of Search ..... 34/9, 13, 15, 20, 35, 34/86; 44/1 G, 2

[56] References Cited

U.S. PATENT DOCUMENTS

| | | | |
|---|---|---|---|
| 3,007,254 | 11/1961 | Schuster | 34/15 |
| 3,552,031 | 1/1971 | Evans et al. | 34/9 |
| 3,802,956 | 4/1974 | Backlund | 162/19 |
| 3,982,789 | 9/1976 | Funk | 406/105 |
| 4,124,440 | 11/1978 | Sherman | 162/246 |
| 4,514,910 | 5/1985 | Elmore et al. | 34/15 |

OTHER PUBLICATIONS

Derammelaere et al. article, "Mechanical Dewatering, Thermal Drying, and Dust Collection: An Integrated Approach", pp. 19–24.

Miscellaneous brochures for Vortex Sieve, Lamella Gravity Separator, and Vibratory Centrifuge.

*Primary Examiner*—Larry I. Schwartz

*Assistant Examiner*—David W. Westphal

*Attorney, Agent, or Firm*—Cushman, Darby & Cushman

[57] ABSTRACT

A method and apparatus are provided for the dehydration of low rank coal, such as lignite, utilizing hot water. Particles of low rank coal are preheated, entrained in liquid, fed to a high pressure feeder, and transferred into a high pressure loop leading to a heat exchange vessel, and at a pressure of about 500–1,000 psi. Particles discharged from the bottom of the heat exchange vessel pass to the top of a dehydration vessel. Water at a temperature (e.g. 250°–260° C. at 700 psi) sufficient to facilitate dehydration of the coal is fed to the bottom of the heat exchange vessel, and to the particles as they pass from the heat exchange vessel to the dehydration vessel. For particles withdrawn from the bottom of the dehydration vessel the pressure is gradually reduced so that they do not explode, and then the liquid and particles are separated while still at a temperature of about 180°–200° F. utilizing a vibrating dewatering screen, Vortex sieve, and vibratory centrifuge. Liquid is withdrawn from a screen at a central portion of the dehydration vessel and fed to the bottom of the heat exchange vessel, and liquid is withdrawn from a central screen of the heat exchange vessel, passed to flash tanks, a Lamella gravity settler, and a disk filter, sodium, sulfur, and other minerals in the withdrawn liquid being removed from the system.

20 Claims, 2 Drawing Figures

FROM 19
FROM 18
LOW RANK COAL
10
11
12
13
14
15
16
LOW PRESSURE STEAM
17
21
22
23
24
25
26
27
28
29
30
31
32
33
34
35
36
37
38
39
40
41
43
44
45
46
47
49
50
54
56
57
58
59
60
61
62
83
84

68
67
DISPOSAL
66
FINES
65
18
19
85
85
63
DISPOSAL
64
VENT
71
73
72
73
77
76
50
51
92
70
73
82
52
53
91
95
74
75
93
94
54
90
81
DRIED LOW RANK COAL
55
FLUE GAS
FRESH WATER
56
80
42
43
H.P. STEAM
BOILER

HOT WATER DRYING OF LOW RANK COAL

BACKGROUND AND SUMMARY OF THE INVENTION

The invention relates to a method and apparatus for the dehydration of solid porous organic material or the like, particularly for the dehydration of low rank coal, such as lignite and sub-bituminous coal, utilizing hot water drying.

In co-pending application Ser. No. 468,675 filed Feb. 22, 1983, a method and apparatus are provided for removing about 60–80 percent of the water content of the low rank coal. In the method described therein, the basic procedure is steam drying of the coal on a continuous basis.

The method and apparatus according to the present invention differ from those disclosed in said co-pending application in that instead of the utilization of direct steam heat for effecting dehydration, utilizing a single vessel, hot water is utilized to effect the dehydration, a two vessel system being provided and heating of the water being accomplished by use of a heat exchanger.

While the invention illustrated and described in said co-pending application Ser. No. 468,675 is very effective in dehydrating low rank coal, since the steam that is utilized for heat condenses on the coal, the condensate water eventually ends up going to waste when it mixes with the water of dehydration. Thus a substantial amount of fresh make-up water is necessary. Also, in the method and apparatus described in said co-pending application, the waste liquid discharged from the dehydrater, and flashed into steam, contains more heat than is desirable.

According to the present invention, a method and apparatus are disclosed which minimize consumption of fresh water relative to the method and apparatus disclosed in said co-pending application, and maximize the efficient use of the heat added to the system.

According to one aspect of the present invention, a method of dehydrating low rank coal is provided comprising the following continuous steps: Establishing a first flow stream of particulate low rank coal. Preheating the first flow stream of particles to a medium temperature, i.e. 110°–120° C. Immersing the first flow stream of particles in water. Transferring the particles flowing in the first stream immersed in water to a second flow stream having a pressure higher than in the first flow stream, but at a temperature less than the steam saturation temperature of the first stream. Feeding the particles in the second flow stream to the top of a heat exchange vessel, and extracting the low temperature liquid from the particles at the top of the heat exchange vessel and recirculating the extracted liquid to the second flow stream. Introducing hot wash liquid, i.e. 230°–250° C., adjacent but above the bottom of the heat exchange vessel to flow upwardly to further preheat coal and to accomplish high temperature energy recovery. Introducing hot liquid (e.g. 250°–260° C., at 700 psi) to the bottom of the heat exchange vessel, to flow downwardly therein, the water having a temperature sufficient to facilitate dehydration of the low rank coal particles. Discharging low rank coal particles from the bottom of the heat exchange vessel. Feeding the low rank coal particles discharged from the bottom of the heat exchange vessel, with hot water, to the top of a dehydration vessel, and extracting liquid from the particles at the top of the dehydration vessel and recirculating the extracted liquid to the heat exchange vessel; this liquid is heated by a heat exchanger, and provides the hot liquid introduced at the bottom of the heat exchange vessel. Effecting counter-current washing of the particles at the bottom of the dehydration vessel to cool and wash the particles at the bottom of the dehydration vessel. Withdrawing hot spent wash water, and dehydration water, from the dehydration vessel for introduction to the heat exchange vessel. Cooling the particles of low rank coal before they are discharged from the bottom of the dehydration vessel prevents break-up of the particles during depressurization, the particles being withdrawn in a third particle flow stream, by transferring the particles flowing in the third flow stream to a fourth, lower pressure flow stream. Separating the water from the particles in the fourth flow stream to flow the particles in a fifth flow stream. And, evaporatively cooling the particles flowing in the fifth flow stream to produce dehydrated low rank coal in a dry form.

According to another aspect of the present invention an apparatus is provided for dehydrating solid porous organic material or the like, such as low rank coal. The apparatus comprises: A first high pressure feeder including a low pressure first material flow loop, and a high pressure second material flow loop. A vertical heat exchange vessel having a liquid extraction means at the top thereof, a hot water liquid introduction means adjacent the bottom thereof, and a material discharge device at the bottom thereof. A conduit connecting the first high pressure feeder second loop to the extraction means at the top of the heat exchange vessel, and another conduit returning from the extraction means to the first high pressure feeder. A vertical dehydrating vessel. A conduit operatively interconnecting the material discharging device adjacent the bottom of the heat exchange vessel and a liquid extraction means at the top of the dehydration vessel. A conduit operatively interconnecting the liquid extracted from the extracting means at the top of the dehydration vessel to the hot water introduction to the bottom of the heat exchange vessel, this conduit including a heat exchanger disposed therein, and a fluid having a temperature higher than the temperature of liquid in said conduit fed to said heat exchanger. Temperature control means for sensing the temperature of liquid in the conduit including the heat exchanger, and controlling the amount of heated fluid fed to the heat exchanger in response to the temperature sensing. A means in the dehydration vessel for washing and cooling and for withdrawal of hot spent wash liquid and a conduit interconnecting said means with the heat exchange vessel to effect transfer of heat from dehydrated coal to fresh, undehydrated coal. A second high pressure feeder, including a third material flow high pressure loop, and a fourth material flow low pressure loop. A material discharge device adjacent the bottom of said dehydration vessel. A conduit interconnecting the discharge device of the dehydration vessel to the second high pressure feeder and defining a part of the third flow loop, and another conduit extending from the second high pressure feeder in the third loop and connected to a conduit for introducing water adjacent the bottom of the dehydration vessel. And, liquid-material separating means operatively connected to the second high pressure feeder by a conduit defining the fourth material low pressure loop. The liquid/material separator means operatively connected to the second high pressure feeder preferably includes a vibrating dewatering screen, a Vortex sieve, and a vibratory centrifuge.

It is the primary object of the present invention to provide an effective continuous method—and apparatus for practicing the method—for dewatering low rank coal, such as lignite and sub-bituminous coal, utilizing hot water drying, to minimize water and energy consumption. This and other objects of the invention will become clear from an inspection of the detailed description of the invention, and from the appended claims.

DETAILED DESCRIPTION OF THE PREFERRED EMBODIMENT

Figure 1A:
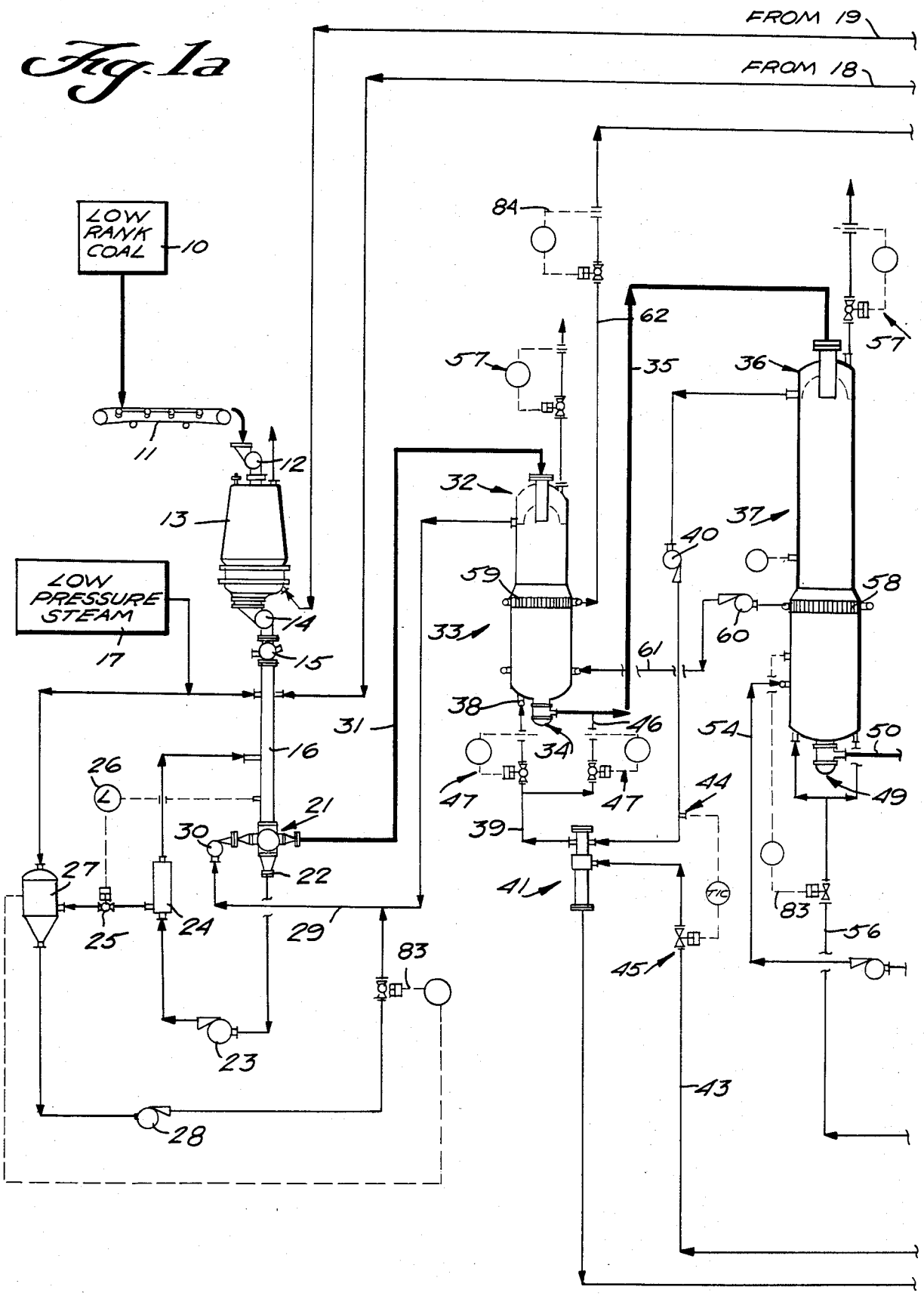
FIGS. 1*a* and 1*b* schematically illustrate exemplary apparatus according to the present invention, for practicing an exemplary method according to the present invention.

The apparatus and method according to the present invention are utilizable for dehydrating low rank coal, such as lignite or sub-bituminous coal. By practicing the invention, the water content of such low rank coal can typically be reduced substantially, while substantial amounts of the sulfur, sodium, and other mineral contaminants in the coal can be removed from the system, with a minimum energy consumption, and with minimum fresh water useage. For convenience, the invention will be described with respect to the dehydration of lignite, but it is understood that it is applicable to other solid porous organic material, and particularly other low rank coals.

Particlized lignite is discharged from a source 10 to a conveyor 11, passing through air lock 12 to a conventional atmospheric steaming bin 13, such as utilized in the pulp and paper field and shown in U.S. Pat. No. 4,124,440. The lignite then passes through meter 14 and low pressure feeder 15 to a chute 16 in which it is entrained in liquid. Preheating of the lignite occurs from the atmospheric steaming in bin 13, and from low pressure steam which may be added to the chute 16 from source 17 (FIG. 1*a*) and first flash tank 18 (FIG. 1*b*). Steam for the bin 13 may be provided from second flash tank 19 (FIG. 1*b*).

The particlized lignite entrained in liquid (e.g. water) in the chute 16 is in a low pressure circulation loop for a first high pressure feeder 21. An exemplary high pressure feeder that is utilizable in the practice of the present invention is shown per se in U.S. Pat. No. 3,982,789. Conventional feeder circulation loops, liquid level maintenance devices, and the like that are utilizable in the practice of the present invention are shown in U.S. Pat. No. 3,802,956.

A screen is disposed at the low pressure outlet 22 of the first high pressure feeder 21, and liquid withdrawn therethrough by pump 23 passes through in-line drainer 24, and the like, controlled by level control valve 25, whereby the desired liquid level in the chute 16 is established. Device 26 senses the liquid level in the chute 16, and controls valve 25 in response thereto. Some liquid passes to level tank 27, and in tank 27 is heated by low pressure steam supplied from source 17, and is pumped by pump 28 to the high pressure inlet line 29 to the high pressure feeder 21. Level control means 38 maintains the liquid level in level tank 27.

Pump 30 provides the flow for the high pressure loop of the feeder 21, the pressure of the particlized lignite entrained in liquid being about 500–1,000 psig (e.g. 700 psig), and the conduit 31 defining a second particle flow stream.

Lignite particles entrained in water in line 31 pass to a conventional liquid/extraction structure 32 disposed at the top of a vertical heat exchange vessel 33. Liquid extracted by the structure 32 passes into line 29, back to pump 30, with heated make-up liquid being supplied thereto by pump 28.

At the bottom of heat exchange vessel 33 is a conventional particles-entrained-in-liquid discharge device 34, which passes lignite particles entrained in liquid into conduit 35, and ultimately to the conventional liquid-/extraction device 36 disposed in the top of a dehydration vessel 37.

Hot water is added to the bottom of the heat exchange vessel 33, the water being at sufficient temperature (e.g. 250°–260° C. at 700 psi) to facilitate dehydration of the lignite. The hot water is typically introduced through inlet 38, which is connected to conduit 39 which is in operative communication, through pump 40, with the extraction means 36. Liquid withdrawn from the top of the dehydration vessel 37 passes through the line 39 to be introduced as final heating water to mix with lignite particles in the bottom of heat exchange vessel 33. A heat exchanger 41 is disposed in line 39 to heat the water therein. The use of the heat exchanger 41 as compared to using live steam to directly heat the coal particles—minimizes fresh water consumption.

The heat exchanger 41 is provided with heated fluid (e.g. steam) from boiler 42 via line 43. The temperature of the liquid in line 39 at point 44 is sensed, and valve 45 in line 43 is controlled in response to this temperature sensing to control the amount of steam fed to the heat exchanger 41 (and thus the degree to which the liquid in line 39 is heated).

Some of the liquid in line 39 is introduced directly into line 35 through conduit 46. Conventional flow sensor and flow control valve systems 47 are provided to control the relative amount of hot water added to vessel inlet 38, and the conduit 35.

At the bottom of dehydration vessel 37 a conventional particles-entrained-in-liquid discharge device 49 is provided, operatively connected to the particles discharge conduit 50. The conduit 50 comprises a third material flow high pressure loop operatively connected to a second high pressure feeder 51, and a fourth material flow stream low pressure loop 52 is also operatively associated with the second high pressure feeder 51. A conventional strainer is provided in high pressure loop outlet 53 from the device 51, and high pressure liquid which passes through the strainer 53 into line 54 is recirculated to the dehydration vessel 37. Fresh water from source 55 also passes through line 56 and is introduced into the bottom of the vessel 37 as wash liquid to countercurrently cool and wash the lignite particles at the bottom of vessel 37.

In both vessels 33 and 37 noncondensible gases, and the like, are vented through conventional vent means 57.

Disposed at a central portion of the dehydration vessel 37 is a screen 58. A central screen 59 is also provided in the heat exchange vessel 33. Hot, spent wash liquid, and dehydration water, withdrawn from vessel 37 by pump 60 through screen 58 passes through line 61 to be introduced into a bottom portion of vessel 33, below the level of the screen 59. The hot, spent wash water, and dehydration water from dehydration vessel 37 flows upwardly, countercurrently to down flowing coal in heat exchange vessel 33 to exit through screen 59 of vessel 33. During countercurrent flow, hot wash water transfers heat to fresh lignite for high temperature energy recovery. The water in line 56 typically would be at about 70° F., and the water in line 61 at about 240° C. (assuming about 260° C. in line 39 and the top of vessel 37). The wash water rate is established by flow control means 84. Fresh water pump 80 supplies water at a pressure greater than dehydration pressure through line 56 to pressure control means 83 to establish dehydration pressure in vessel 37.

The liquid withdrawn from vessel 33 into conduit 62 contains sodium (much in the form of NaCl), sulfur, magnesium, and other minerals. It is desirable to remove these minerals from the system, while at the same time recovering as much of the remaining heat as possible in the withdrawn liquid. This is accomplished by passing the conduit 62 to the two flash tanks 18, 19. A liquid level is maintained in the flash tanks by level control means 85. The liquid withdrawn in line 63 from the second flash tank 19 is first subjected to a thickening action, and then filtering action. Thickening is preferably accomplished in a conventional thickener, such as a Lamella gravity settler 64, with the discharge from settler 64 passing through line 65 to a conventional disk filter 66 operatively connected to vacuum receiver 67 and vacuum pump 68.

The temperature of the lignite particles entrained in liquid in lines 50, 52 is relatively high, e.g. about 180°-200° F. This high temperature is maintained during subsequent liquid/particle separation in order to maximize the efficiency of that separation. The separation is accomplished preferably utilizing a vibratory centrifuge 70—which is much more efficient when the temperature is high—and also preferably the liquid/particle separation is provided utilizing a vibrating dewatering screen 71 (which effects coarse screening), and a Vortex sieve 72 (which effects fine screening). Liquids that pass through the vortex sieve 72 and vibratory centrifuge 70 flow to liquid level tank 95 through lines 92 and 91, respectively. Pump 82 draws liquid from tank 95 to complete the fourth low pressure loop. Pump 81 supplies fresh water through line 90 to make up for liquids lost as surface moisture on lignite in line 73 and displacements in high pressure feeder 51, make up being controlled by level means 94.

The particles flowing in the flow stream 73 are at atmospheric pressure, and are evaporatively cooled in the vibratory drier 74, to provide the main stream 75 of dried coal. The cooling gases can be atmospheric air, however non-combustible boiler flue gases are preferable. The moist off-gases in the conduit 76 from the vibratory drier 74 are passed to a mechanism for separating the lignite fines from the gas, such as a conventional gas cyclone 77, with the fines removed by the cyclone 77 discharged to the main lignite stream 75.

Figure 1B:
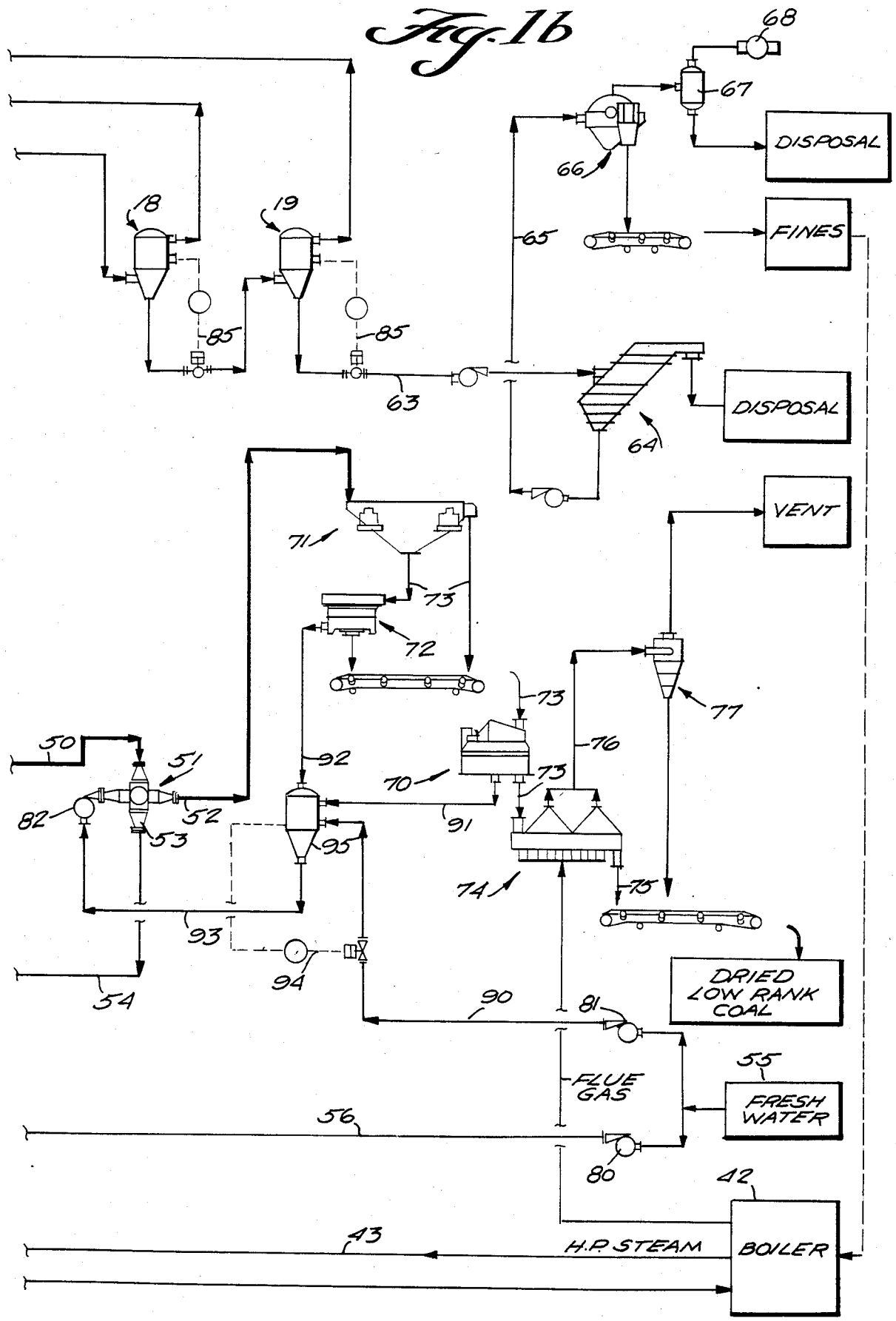

In the practice of an exemplary method according to the invention utilizing the apparatus illustrated in FIGS. 1*a* and 1*b* dehydration of low rank coal is accomplished in a continuous manner by: Establishing a first flow stream of particulate low rank coal (from source 10 through atmospheric steaming bin 13). Preheating the first flow stream of particles (as with low pressure steam from sources 17 and 18, and with atmospheric steam from source 19). Immersing the first flow stream of particles in water (in chute 16). Transferring the particles flowing in the first flow stream immersed in water to a second flow stream, 31, having a pressure substantially higher than that in the first flow stream, but at a temperature below steam saturation temperature of the first stream (so as to avoid "hammering" in the high pressure feeder 21). Passing the particles from conduit 31 to the heat exchange vessel 33, extracting liquid at the top of the vessel 33 to return to the high pressure feeder 21 through line 29. Introducing hot water, having a heat (e.g. 250°-260° C.) sufficient to facilitate dehydration of the low rank coal, into the bottom of vessel 33 at inlet 38. Passing low rank coal particles, entrained in liquid, discharged from discharge device 34 of vessel 33 in line 35, along with hot water introduced through line 46, to the top of dehydration vessel 37. Recirculating the water extracted by extraction means 36 at the top of dehydration vessel 37 in line 39, passing through heat exchanger 41 which is controlled by a temperature sensor 44 and valve 45 to heat the water in line 39 to the desired temperature. Effecting countercurrent cooling and washing of coal particles at the bottom of vessel 37, cool wash liquid being introduced through conduit 56 and including liquid displaced from second high pressure feeder 51 backwardly, the wash liquid counter-currently cooling and washing the coal particles at the bottom of vessel 37. Withdrawing spent hot wash liquid, and water of dehydration, from screen 58 of vessel 37, through line 61. Effecting high temperature heat recovery from hot wash liquid, hot wash liquid being introduced through conduit 61 to heat exchange vessel 33 to flow counter-currently to undehydrated lignite, substantially resulting in a transfer of heat from dehydrated lignite to undehydrated lignite. And, utilizing second high pressure feeder 51 operatively connected up as illustrated in the drawings to depressurize the coal particles.

The particles in the third flow stream 50 pass through high pressure feeder 51 to the fourth flow stream 52. Lignite and liquids in streams 50, 52 are at a relatively high temperature (e.g. about 180°-200° F.). Liquid/particle separation thereof is then effected, at this high temperature (in order to maximize efficiency) utilizing the vibratory centrifuge 70, and the other components 71, 72, etc. Evaporative cooling takes place in the vibratory drier 74.

From screen 59 of vessel 33 liquid, with much of the heat withdrawn therefrom, passes through line 62 to flash tanks 18, 19. The liquid contains sodium, manganese, sulfur, and like minerals, and those minerals are contained in the liquid discharge 63 from second flash tank 19. The Lamella gravity settler 64, and disk filter 66, treat that liquid, the minerals being removed and/or disposed of, and lignite fines being returned to boiler 42.

It will thus be seen that according to the present invention a method and apparatus have been provided for effective continuous hot water dehydration of low rank coal. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and devices.

What is claimed is:

1. A method of dehydrating low rank coal utilizing a heat exchange vessel having a top and a bottom, and comprising the steps of continuously:

(a) establishing a first flow stream of particulate low rank coal;

(b) preheating the first flow stream of particles;
(c) immersing the first flow stream of particles in water;
(d) transferring the particles flowing in the first stream immersed in water to a second flow stream having a pressure higher than in said first flow stream, but at a temperature less than the steam saturation temperature of the first stream;
(e) feeding the particles in the second flow stream to the top of the heat exchange vessel, and extracting liquid from the particles at the top of the heat exchange vessel and recirculating the extracted liquid to the second flow stream;
(f) introducing hot water to the bottom of the heat exchange vessel, to flow downwardly therein, the water having a temperature sufficient to facilitate dehydration of the low rank coal particles;
(g) discharging low rank coal particles from the bottom of the heat exchange vessel;
(h) feeding the low rank coal particles discharged from the bottom of the heat exchange vessel, with hot water, to the top of a dehydration vessel;
(i) extracting liquid from the particles at the top of the dehydration vessel and recirculating the extracted liquid to the heat exchange vessel;
(j) effecting counter-current washing of the particles at the bottom of the dehydration vessel to cool and wash the particles at the bottom of the dehydration vessel;
(k) withdrawing spent hot wash water, and water of dehydration, from the dehydration vessel and directing the hot spent wash water, and water of dehydration, to the heat exchange vessel to flow countercurrently to the low rank coal therein to effect a substantial recovery of heat from dehydrated low rank coal; and
(l) depressurizing the particles of low rank coal as they are discharged from the bottom of the dehydration vessel, the particles being withdrawn in a third particle flow stream, by transferring the particles flowing in the third flow stream to a fourth, lower pressure flow stream.

2. A method as recited in claim 1 wherein the particles and liquid in the fourth stream are at a relatively high temperature, and comprising the further steps of: (m) separating the water from the particles in the fourth flow stream to flow the particles in a fifth flow stream; and (n) evaporatively cooling the particles flowing in the fifth flow stream to produce dehydrated low rank coal in a dry form.

3. A method as recited in claim 2 wherein step (m) includes the step of passing the particles and water at relatively high temperature to a vibratory centrifuge.

4. A method as recited in claim 3 wherein step (m) comprises the further steps of passing the particles in water to a vibrating dewatering screen, and to a Vortex sieve, before passing them to the vibratory centrifuge, the vibrating dewatering screen effecting coarse screening thereof, and the Vortex sieve effecting fine screening thereof.

5. A method as recited in claim 3 wherein the temperature of the particles and water in the fifth flow stream is about 180°–200° F.

6. A method as recited in claim 2 wherein the temperature of the water introduced in step (f) is about 250°–260° C.

7. A method as recited in claim 2 wherein the spent wash water and water of dehydration removed in step (k) is directed to the bottom of the heat exchange vessel.

8. A method as recited in claim 7 comprising the further step of removing liquid containing minerals from a midportion of the heat exchange vessel, and treating the removed liquid to effect removal or disposal of sodium, sulfur, and other mineral constituents thereof.

9. A method as recited in claim 8 wherein said mineral removal step is practiced by flashing the removed liquid containing minerals into steam; effecting thickening, and filtering of, the liquid from the steam flashing step; and effecting disposal or recovery of materials removed during the thickening and filtering steps.

10. A method as recited in claim 9 wherein said thickening step is practiced by passing the liquid through a Lamella gravity settler.

11. A method as recited in claim 2 comprising the further steps of: sensing the temperature of the liquid withdrawn and recirculated in step (i); adding heat, as necessary, by a heat exchanger to the recirculating liquid to ensure the desired temperature thereof for facilitating dehydration of the low rank coal particles; introducing a portion of the recirculating, heated liquid into the bottom of the heat exchange vessel as the hot water added in step (f), and introducing another portion of the recirculating, heated liquid to the particles being discharged from the heat exchange vessel, in step (h).

12. A method as recited in claim 1 comprising the further steps of: sensing the temperature of the liquid withdrawn and recirculated in step (i); adding heat, as necessary, by a heat exchanger to the recirculating liquid to ensure the desired temperature thereof for facilitating dehydration of the low rank coal particles; introducing a portion of the recirculating, heated liquid into the bottom of the heat exchange vessel as the hot water added in step (f), and introducing another portion of the recirculating, heated liquid to the particles being discharged from the heat exchange vessel, in step (h).

13. A method as recited in claim 1 wherein step (b) is practiced by heating the first flow stream with atmospheric and/or low pressure steam.

14. A method as recited in claim 1 wherein the spent wash water and water of dehydration removed in step (k) is directed to the bottom of the heat exchange vessel.

15. A method as recited in claim 14 comprising the further step of removing liquid containing minerals from a midportion of the heat exchange vessel, and treating the removed liquid to effect removal or disposal of sodium, sulfur, and other mineral constituents thereof.

16. A method as recited in claim 15 wherein said mineral removal step is practiced by flashing the removed liquid containing minerals into steam; effecting thickening, and filtering of, the liquid from the steam flashing step; and effecting disposal or recovery of materials removed during the thickening and filtering steps.

17. Apparatus for dehydrating solid porous organic material or the like comprising:
a first high pressure feeder including a low pressure first material flow loop, and a high pressure second material flow loop;
a vertical heat exchange vessel having a top and a bottom, with a liquid extraction means at the top thereof, a hot water liquid introduction means adjacent the bottom thereof, and a material discharge device at the bottom thereof;

a first conduit connecting said first high pressure feeder second loop to the extracting means at the top of the heat exchange vessel, and a second conduit returning from the extracting means to the first high pressure feeder;

a vertical dehydrating vessel;

a third conduit operatively interconnecting the material discharging device adjacent the bottom of the heat exchange vessel and a liquid extracting means at the top of the dehydration vessel;

a fourth conduit operatively interconnecting the liquid extracted from the extracting means at the top of the dehydration vessel to the hot water introduction to the bottom of the heat exchange vessel, said conduit including a heat exchanger disposed therein, a fluid having a temperature higher than the temperature of liquid in said conduit fed to said heat exchanger to effect heating of the liquid;

temperature control means for sensing the temperature of liquid in said fourth conduit said heat exchanger, and controlling the amount of heated fluid fed to the heat exchanger in response to said temperature sensing;

a second high pressure feeder, including a third material flow high pressure loop, and a fourth material flow low pressure loop;

a material discharge device adjacent the bottom of said dehydration vessel;

a fifth conduit interconnecting the discharging device of the dehydration vessel to the second high pressure feeder and defining a part of the third flow loop, and a sixth conduit extending from the second high pressure feeder in the third loop and connected to a conduit for introducing water adjacent the bottom of the dehydration vessel; and liquid-material separating means operatively connected to the second high pressure feeder by a seventh conduit, which conduit defines the fourth loop.

18. Apparatus as recited in claim 17 wherein said liquid/material separator means operatively connected to the second high pressure feeder includes a vibrating dewatering screen, a Vortex sieve, and a vibratory centrifuge.

19. Apparatus as recited in claim 17 further comprising a withdrawal screen at a central portion of said dehydration vessel, said withdrawal screen operatively connected to a conduit for feeding withdrawn liquid from said dehydration vessel to a bottom portion of said heat exchange vessel.

20. Apparatus as recited in claim 17 further comprising a liquid withdrawal screen at a central portion of said heat exchange vessel, above the level of introduction of liquid withdrawn from said dehydration vessel into said heat exchange vessel; and a conduit extending from said withdrawal screen of said heat exchange vessel, said conduit operatively connected to means for separating sodium, sulfur, and like minerals from liquid in said conduit.

* * * * *